United States Patent [19]

Hardy

[11] 4,325,280

[45] * Apr. 20, 1982

[54] DEVICE FOR DEADENING DRUMHEADS

[75] Inventor: Bruce N. Hardy, Elkhart, Ind.

[73] Assignee: Silver Street, Incorporated, Elkhart, Ind.

[ * ] Notice: The portion of the term of this patent subsequent to Jan. 13, 1998, has been disclaimed.

[21] Appl. No.: 139,719

[22] Filed: Apr. 14, 1980

[51] Int. Cl.[3] ..... G10D 13/02

[52] U.S. Cl. ..... 84/411 M

[58] Field of Search ..... 84/411 R, 411 A, 411 M, 84/412, 413, 414, 415, 416, 417, 418, 419, 420, 421

[56] References Cited

U.S. PATENT DOCUMENTS 3,951,032 4/1976 LaPorta ..... 84/411 M 4,244,266 1/1981 Hardy ..... 84/411 M

*Primary Examiner*—Lawrence R. Franklin

*Attorney, Agent, or Firm*—Marmaduke A. Hobbs

[57] ABSTRACT

A device for deadening drumheads, to reduce the ringing phenomenon associated principally with synthetic membranes, in which a plurality of bodies of porous, pliable material are disposed around the preferred attack area of the drum membrane. Each of the bodies has an adhesive layer on one surface, and the adhesive layer is used to attach the body to a drumhead membrane. When the device is secured to the membrane, the bodies do not interfere substantially with the initial vibrations induced when the drum membrane is struck by the drummer; however, the bodies absorb the reflected vibrations which return toward the center of the drum and cause the ringing phenomenon. The bodies may be circular, square, rectangular, or of other shapes, and may be in a variety of colors.

19 Claims, 7 Drawing Figures

DEVICE FOR DEADENING DRUMHEADS

Drummers have long been faced with a problem known as drumhead ring, or more simply, ringing. This phenomenon is characterized by a distorted drum tone, which varies in pitch as successive drum beats are induced. Ringing presented only a minor problem when drum membranes were made principally of natural products such as calfskin or other "gut" type materials. With the increased popularity of synthetic drum membranes, ringing has recently presented a more severe problem. The synthetic membranes produce a more discernible ring of louder volume than do natural product membranes; thus, even a musically untrained listener may notice the distorted tone quality of the synthetic membrane. When electronic amplification is used to increase the volume of the drum sound, ringing becomes even more noticeable. As a result of some very significant advantages of synthetic membranes over natural product membranes, which make the use of synthetic membranes popular, it is highly desirable to minimize drumhead ring.

In an effort to eliminate drumhead ring, while retaining the utmost in percussive tonal quality, drummers have tried various approaches, with mixed results. Moderate success has been achieved in reducing ringing by placing soft materials such as rugs, pillows, or the like in the drum shell and against the drum membrane. While this approach may be of some utility to a stationary drummer, it is impractical at best for a marching drummer. The use of pillows or rugs is also unsightly, especially when transparent drum membranes are used, and traveling bands are inconvenienced by the need to carry the large bulky items. To some extent, pillows, rugs, or the like placed in the drum shell also retard the desired drum sound in addition to retarding ringing. Thus, the desired tone and volume of the drum may be adversely affected.

A device which effectively reduces drumhead ring, without substantially interfering with the desired drum tone, and without substantially adding to the weight of the drum, is disclosed in my patent hoc a "Drumhead Deadening Device", U.S. Pat. No. 4,244,266 issued Jan. 13, 1981. The present invention relates to an improvement in and/or a simplified and more versatile alternative to the aforementioned device, and has as one of its principal objects to provide a drumhead deadening device which can be attached to the inside of a drumhead membrane to substantially reduce the ringing phenomenon commonly associated with synthetic membranes, while not interfering with the playing of the drum, and which will present a pleasing appearance on transparent membranes.

Another object of the present invention is to provide a simplified and versatile device for deadening drumheads which securely attaches to the drumhead membrane, permitting advantageous use of the device on drums carried by marching band members, and which attaches quickly, easily and securely so that only a one time installation is required, and traveling drummers need not carry the device apart from the drum, nor attach the device prior to each use of the drum.

A further object of the present invention is to provide a device for deadening drumheads which substantially reduces the ringing phenomenon while having no significant effect on the desired percussive tones, quality, and volume of the drum, and which can be used advantageously on dual headed drums to eliminate ringing of both the attack and resonating drumheads.

A still further object of the present invention is to provide a device for deadening drumheads which can be manufactured in a variety of shapes and colors and installed on the drumhead in a variety of patterns to provide unique visual appearances through transparent drum membranes, and which can be manufactured inexpensively and in a manner for installation which requires only a minimal time and effort by the user of the device.

Additional objects and advantages of the present invention will become apparent from the following detailed description and the accompanying drawings, wherein.

Figure 1:
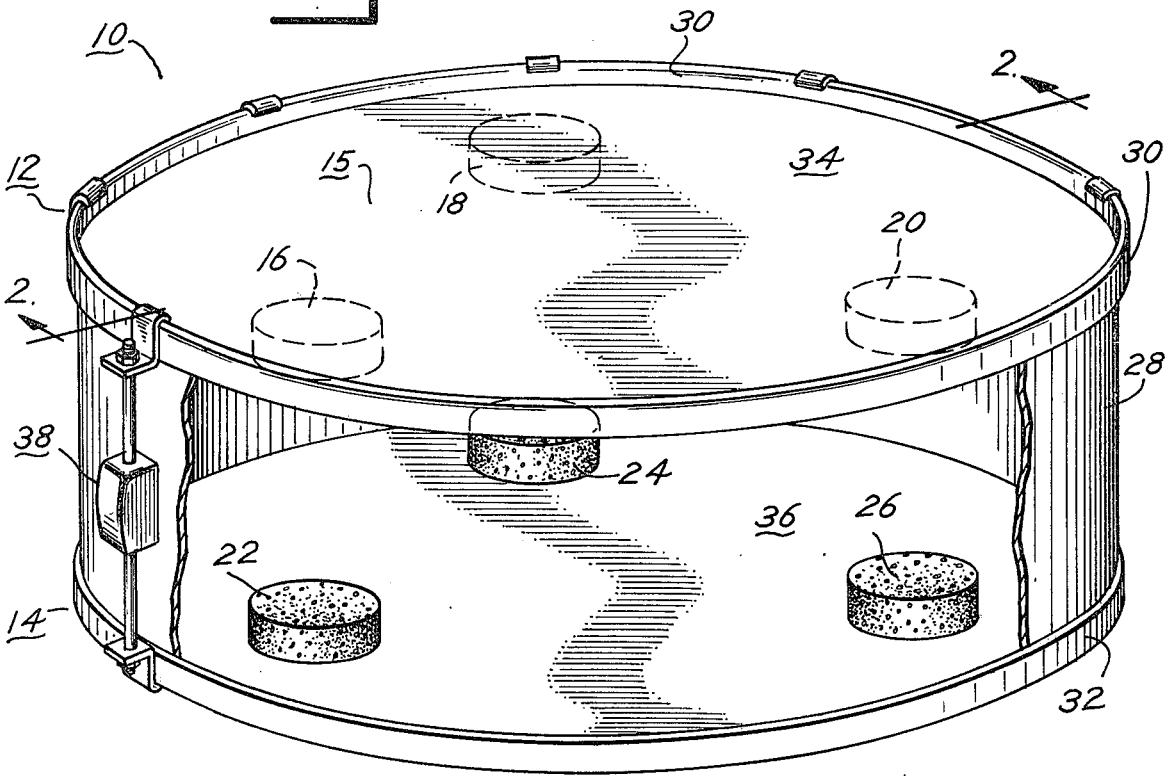
FIG. 1 is a perspective view of a dual headed drum having drumhead deadening devices embodying the present invention on both the attack and resonating drumheads.

Referring more specifically to the drawings, and to FIG. 1 in particular, numeral 10 designates a dual headed drum, having an attack head 12 and a resonating head 14. A device 15, including bodies 16, 18 and 20, embodying the present invention, is disposed on attack head 12 to minimize ringing of the attack head. A device 21, including bodies 22, 24 and 26, embodying the present invention, is disposed on resonating head 14 to minimize ringing of the resonating head.

Drum 10 is a conventional drum structure, having a shell 28 between attack head 12 and resonating head 14. The heads of drum 10 are similar in construction, having rims 30 and 32 surrounding membranes 34 and 36, respectively. The membranes are of plastic, such as nylon or other synthetic material commonly used in drumhead membranes, or they may be of calfskin or other natural products. The device of the present invention works equally well on synthetic membranes and natural membranes; however, since the ringing phenomenon is more pronounced in synthetic membranes than in natural membranes, the present device is more advantageous when used on a synthetic membrane. A plurality of tensioning devices 38 are disposed between attack head 12 and resonating head 14, and may be adjusted to tighten the membranes against shell 28. The device of the present invention may also be used on single headed drums, and will operate as effectively to eliminate drumhead ring as on the dual headed drum structure shown in FIGS. 1 and 2. The device may also be used on drums of virtually any size, from small diameter tom-tom drums to large diameter bass drums.

Each of the bodies 16, 18, 20, 22, 24 and 26 consists of a pad 50 of foam rubber, foam polyester, or other porous and pliable material. An adhesive layer 52 is disposed on the pad, to attach the pad to the drum membrane, on the side of the membrane within shell 28. Any adhesive suitable for use on the material of pad 50 may be used; however, the types of adhesive commonly used on bumper stickers and the like are particularly appropriate, in that these types of adhesive will permit the use of a peel-off type protective layer 54 on the adhesive. Hence, the bodies are normally manufactured and sold with the adhesive on the pad, so that during installation of the bodies the protective layer may be removed, and the pad may be attached without further application of adhesive. Normally, a plurality of bodies are placed around the preferred attack area of the membrane.

Figure 2:
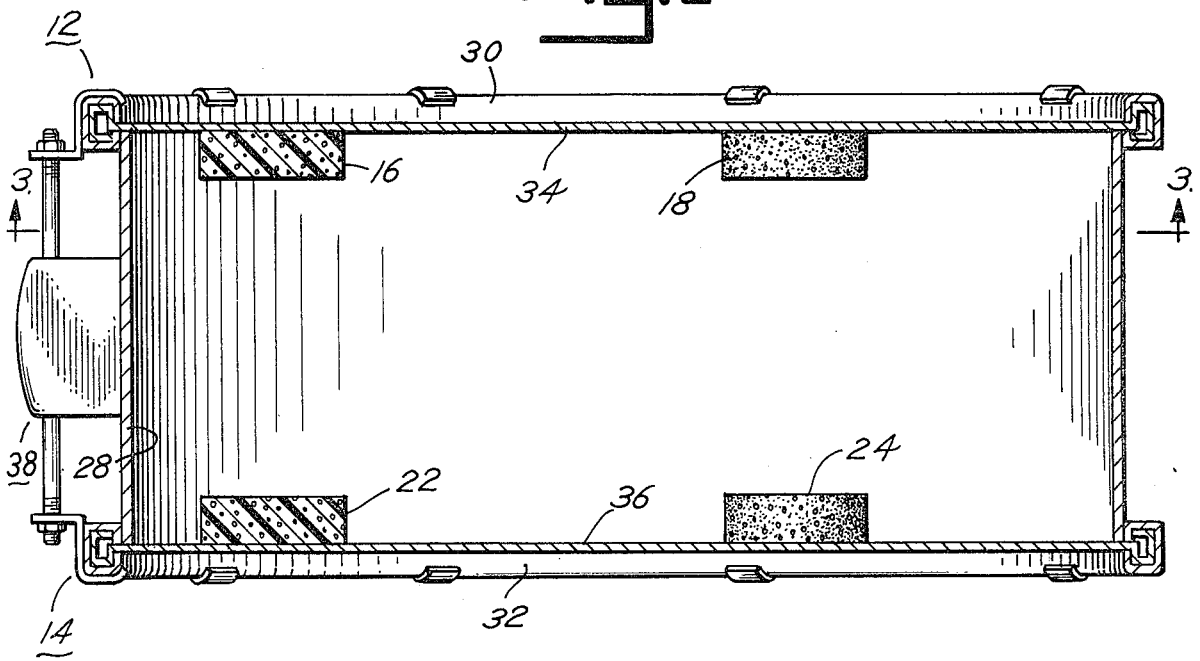
FIG. 2 is a cross sectional view of the drum and deadening devices shown in FIG. 1, taken on line 2—2 of the latter figure.
Figure 3:
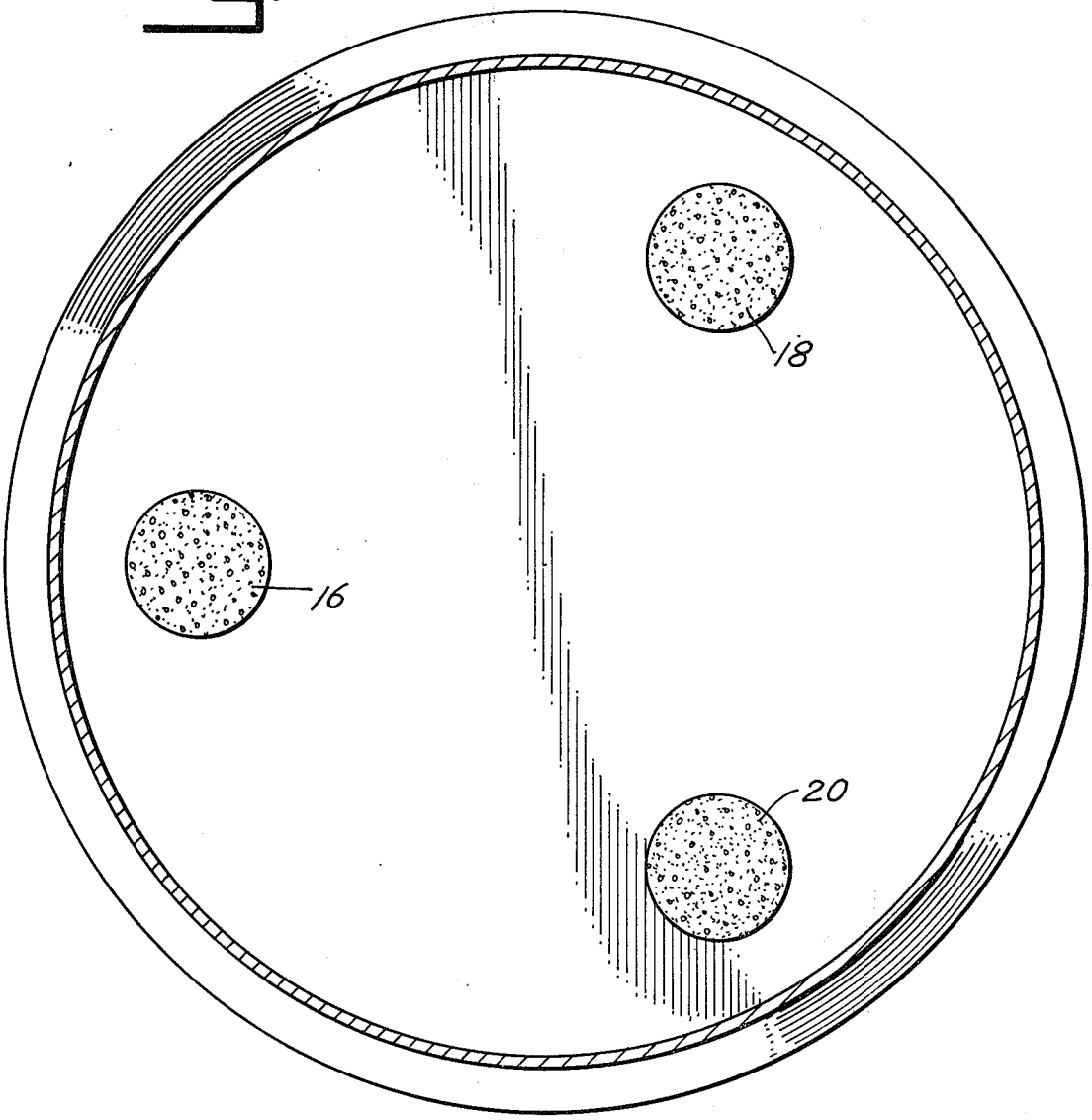
FIG. 3 is a horizontal cross sectional view of the drum shown in the preceding figures, taken on line 3—3 of FIG. 2.
Figure 6:
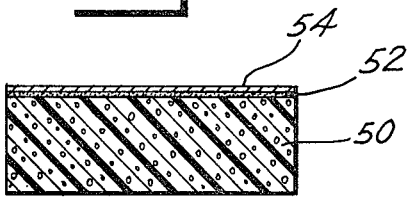
FIG. 6 is a cross sectional view of one of the devices for deadening drumheads prior to installation on the membrane.
Figure 4:
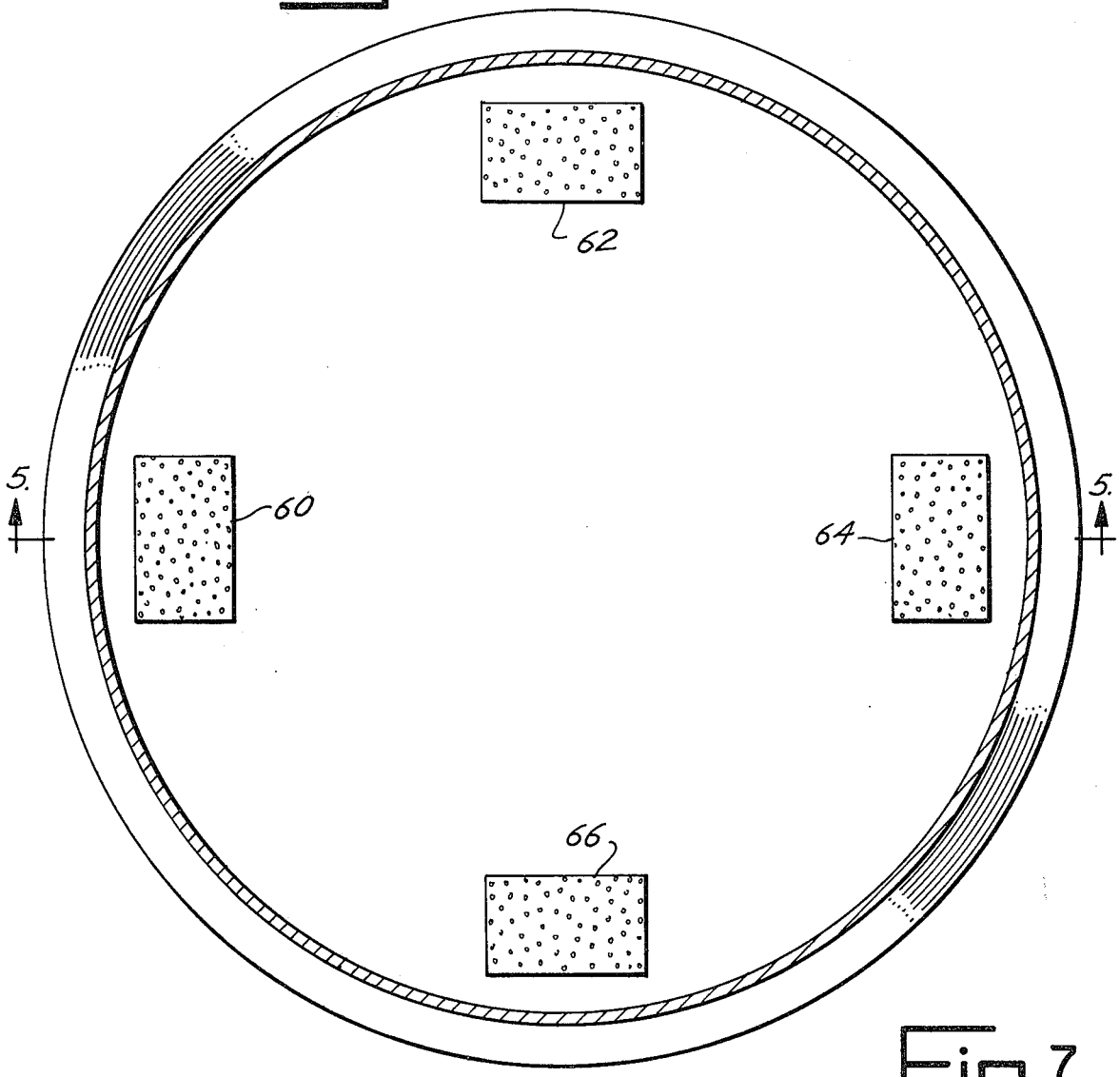
FIG. 4 is a cross sectional view similar to that of FIG. 3, but showing a modified form of drumhead deadening device attached to the drum membrane.
Figure 7:
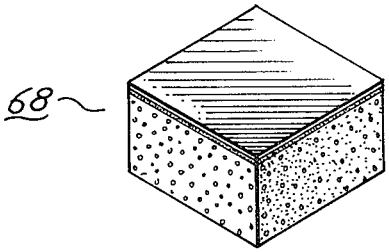
FIG. 7 is a perspective view of yet another modified form of the device for deadening drumheads.
Figure 5:
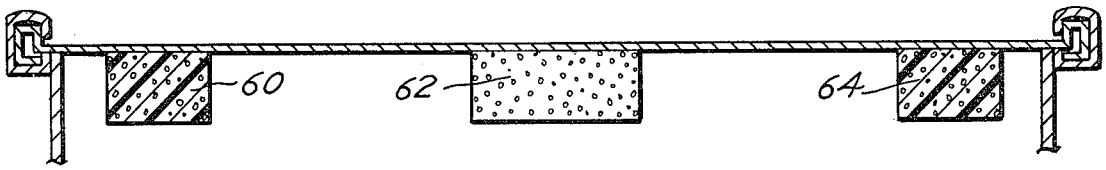
FIG. 5 is a cross sectional view of the drum and device shown in FIG. 4, taken on line 5—5 of the latter figure.

The bodies of the devices shown in FIGS. 1, 2 and 3 are of substantially circular shape; however, the device works equally well when the bodies are of shapes other than a circle. FIGS. 4 and 5 shows bodies 60, 62, 64 and 66 which are rectangular in shape, and FIG. 7 shows another modified embodiment in which the body 68 is substantially square in shape. The rectangular and square shaped bodies work equally as well as the circular shaped bodies shown in the preceding figures, to reduce drumhead ring. Each of the bodies, regardless of its shape, is of porous pliable material which reacts with the membrane to reduce ringing, while not substantially interfering with desired drum sounds. The adhesive and protective layer arrangements, as previously described, may be used, or a suitable adhesive may be applied when the body is to be attached to the membrane. It is believed that drumhead ring is caused when vibrations of the drumhead, which are traveling toward the periphery of the membrane, are reflected by the shell or rim toward the center of the drum, and the reflected vibrations meet new originating vibrations traveling toward the outside of the membrane. The bodies of the present invention, in any of the previously described shapes, operate to reduce drumhead ring, it is believed, by absorbing the vibrations of the membrane which are returning toward the center of the drum. The originating vibrations, which are substantially more intense than the return vibrations, are not noticeably interfered with by the present devices.

In the use and operation of a drumhead deadening device embodying the present invention, a plurality of bodies, either round, rectangular or square, are attached to each membrane of the drum. For the most efficient operation of the device, bodies should be placed an equal distance from the preferred attack area at the center of the drum membrane. When placed outwardly from the preferred attack area, the bodies do not substantially interfere with the originating vibrations of the drumhead membrane, and therefore do not substantially affect the desired drum tone and volume. The bodies are attached by removing protective layer 54 and pressing adhesive layer 52 against the drumhead membrane. The number of bodies used on a particular drumhead may be varied; thus, three, four or more of the round shaped bodies shown in FIG. 3 may be used on a drumhead, and greater or lesser numbers of the square or rectangular bodies may be used, rather than the four shown in FIG. 4. Normally, particularly on large drums such as bass drums and the like, it is desirable to use more bodies to eliminate the drumhead ring; however, even the placement of only a few bodies on a large membrane will minimize ring.

The bodies may be manufactured in a variety of different colors as well as in different shapes, so that, when attached to transparent membranes, the bodies will actually enhance the appearance of the drum. The device may take on many different appearances, in that both the number and shape of the bodies making up the device may be varied, as well as the color of the bodies. The devices will remain permanently attached after the initial installation, so that they are particularly suitable for marching drums. The inherent light weight of the materials used in the bodies of the devices adds no perceptible weight to the drum, even when used on both membranes of a dual headed drum.

Although one embodiment and several modifications of a device for deadening drumheads has been shown and described in detail herein, various other changes may be made without departing from the scope of the invention.

I claim:

1. A device for deadening drumheads to minimize the ringing phenomenon associated principally with synthetic drum membranes: said devices comprising a plurality of bodies of porous, pliable material for reacting with one another and with the drumhead membrane, said bodies being positioned generally around the preferred attack area of the membrane, and an adhesive layer on each of said bodies for attaching each of said bodies to the drumhead membrane.

2. A device as defined in claim 1 in which said porous, pliable material is foam rubber.

3. A device as defined in claim 1 in which said porous, pliable material is polyester.

4. A device as defined in claim 1 in which said bodies are of generally circular shape.

5. A device as defined in claim 1 in which said bodies are of generally rectangular shape.

6. A device as defined in claim 1 in which a layer of protective material is disposed on said adhesive, and said protective layer is adapted to be removed from said adhesive when said device is to be attached to said membrane.

7. A device as defined in claim 1 which said bodies are positioned equidistant from the preferred attack area and from each other.

8. In a conventional drum structure having a drumhead membrane: a device for deadening drumhead ring from said membrane comprising a plurality of bodies of porous pliable material for reacting with said membrane, said bodies being positioned around the preferred attack area of the membrane, and an adhesive for attaching each of said bodies to said membrane.

9. In a drum structure: a device for deadening drumhead ring as defined in claim 8 in which said porous, pliable material is foam rubber.

10. In a drum structure: a device for deadening drumhead ring as defined in claim 9 in which said bodies are of generally circular shape.

11. In a drum structure: a device for deadening drumhead ring as defined in claim 8 in which said porous, pliable material is polyester.

12. In a drum structure: a device for deadening drumhead ring as defined in claim 11 in which said bodies are of generally rectangular shape.

13. In a drum structure: a device for deadening drumhead ring as defined in claim 8 in which a layer of protective material is disposed on said adhesive, and said protective layer is adapted for removal from said adhesive when said device is to be attached to said membrane.

14. In a drum structure: a device for deadening drumhead ring as defined in claim 8 in which said bodies are positioned equidistant from the preferred attack area and from each other.

15. A drum with a drumhead deadening device, comprising a drumhead membrane, an outer rim disposed on the periphery of said membrane, a plurality of spaced apart bodies of porous, pliable material disposed generally around the preferred attack area of said membrane for reacting with said membrane to reduce drumhead ring, and an adhesive for attaching said bodies to said membrane.

16. A drum with a drumhead deadening device as defined in claim 15 in which said porous pliable material is foam rubber.

17. In a device for deadening drumhead ring: a body of porous, pliable material for reacting with a drumhead membrane, said body being adapted to be positioned radially outwardly from and on only one side of the preferred attack area of said membrane, and an adhesive on said body for attaching said body to said membrane.

18. In a device for deadening drumhead ring: a body as defined in claim 17 in which said porous, pliable material is foam rubber.

19. In a device for deadening drumhead ring: a body as defined in claim 17 in which said porous, pliable material is polyester.

* * * * *

UNITED STATES PATENT AND TRADEMARK OFFICE

CERTIFICATE OF CORRECTION

PATENT NO. : 4,325,280

DATED : April 20, 1982

INVENTOR(S) : Bruce N. Hardy

It is certified that error appears in the above-identified patent and that said Letters Patent are hereby corrected as shown below:

Column 1, line 43, change "hoc" to --- for ---.

Column 3, line 20, change "shows" to --- show ---.

Column 4, line 22, change "devices" to --- device ---.

Signed and Sealed this

Thirteenth Day of July 1982

[SEAL]

*Attest:*

GERALD J. MOSSINGHOFF

*Attesting Officer*

*Commissioner of Patents and Trademarks*